US005560310A

United States Patent [19]

Christensen et al.

[11] Patent Number: 5,560,310

[45] Date of Patent: Oct. 1, 1996

[54] CONTROL UNIT

[76] Inventors: Jan A. Christensen; Carl O. Öhrn, both of Sailmatic A/S, HaugåKervejen 36, No-3132 Husoysund, Norway

[21] Appl. No.: 481,410

[22] PCT Filed: Dec. 22, 1993

[86] PCT No.: PCT/NO93/00197

§ 371 Date: Aug. 31, 1995

§ 102(e) Date: Aug. 31, 1995

[87] PCT Pub. No.: WO94/14647

PCT Pub. Date: Jul. 7, 1994

[51] Int. Cl.[6] ..... B63B 15/00

[52] U.S. Cl. ..... 114/91; 114/124

[58] Field of Search ..... 114/91, 39.1, 89, 114/90, 93, 121, 122, 124, 125

[56] References Cited

U.S. PATENT DOCUMENTS 3,903,827 9/1975 Marcil ..... 114/91
3,985,106 10/1976 Ross ..... 114/91
4,094,263 6/1978 Marcil ..... 114/91
5,392,727 2/1995 Christensen et al. ..... 114/124

*Primary Examiner*—Stephen Avila
*Attorney, Agent, or Firm*—Dvorak and Traub

[57] ABSTRACT

A control unit incorporated in a stabilizing system in yachts and sailing vessels and intended automatically to control the movements of a weight which is movable transversely across the vessel, said wight being connected with an athwartships tiltable mast in such a manner, that the weight is displaced transversely across the vessel in a direction opposite to the mast tilting direction. The control unit comprises two stops arranged to stop the movements of the weight, and further comprises a shifting device which is actuated by the position of the wight so that one of the stops is given an opportunity to act, i.e. to stop the movements of the weight, when the weight is positioned to one side of the centre line of the vessel in the transverse direction thereof whereas the second stop is then not given an opportunity to stop the movements of the weight, and vice versa. Each stop is controlled by a sensing device responsive to the movements of the vessel.

20 Claims, 6 Drawing Sheets

CONTROL UNIT

TECHNICAL FIELD

The subject invention concerns a control unit incorporated in a stabilizing system in yachts and sailing vessels. The unit is intended to automatically control the movements of a weight, which is movable transversely across the vessel, said weight being connected with a mast of a kind which is tiltable athwartships, in such a manner that the weight is displaced transversely across the vessel in a direction opposite to the mast tilting direction.

BACKGROUND OF THE INVENTION

Conventional yachts or sailing vessels often heel over to a comparatively large degree, often about 15°–40°, during sailing in heavy wind, with consequential discomfort and safety hazards to the crew. In addition, the heeling-over increases the vessel propelling resistance and reduces keel efficiency as regards the ability of the latter to counter-act the drift of the vessel. This means that the heeling-over reduces the vessel sailing speed, particularly when beating to windward. The hull configurations of the vessel also need adaptation so as to be relatively efficient during sailing both with and without heeling-over.

In view thereof various sailing vessel stabilizing systems have been developed. One such prior-art stabilizing system is disclosed in Applicant's patent specifications SE 456 237 and EP 0 232 359. This system includes a tiltable mast the shrouds of which are arranged to displace a movable weight in the opposite direction across the vessel to that of the mast tilting direction. The stabilizing force thus created makes it possible to substantially eliminate heeling during normal sailing conditions. To the obvious advantages from the point of view of comfort, safety and performance that are thus created could be added the advantage of making it possible to construct and configure the hull essentially for upright sailing. Consequently, the inner space of the hull could be inreased and its performance characteristics be improved under conditions of upright sailing or travel by motor.

However, also this type and similar types of vessels meet with difficulties as regards the stabilizing systems. If a sailing vessel equipped with the stabilizing system turns sharply to one side, the centrifugal force will displace the mobile weight outwards, athwartships, with the result that during the turning movement the vessel will heel outwards in a most uncomfortable manner. When the vessel is motor operated during heavy sea and heels over alternately to one side or the other by the waves, the heel will become more pronounced because of the displacement in the direction downwards and outwards of the movable weight. This intensifies the vessel rolling motions even further in a non-desirable manner. The same is true when the boat, during spinnaker sailing, starts to oscillate, i.e. to roll from side to side. This rolling motion may then be amplified by the stabilizing system and the broach which often ends an oscillating motion could be more serious than in a conventional sailing vessel.

THE PURPOSE OF THE INVENTION

The purpose of the subject invention is to reduce to a significant degree the problems outlined above so as to ensure that the advantages achieved by a stabilizing system during normal sailing conditions essentially do not lead to disadvantages during more specific sailing conditions. According to the, invention the possibilities to design the hull optimally for upright sailing may be made use of in a more rational and consistent manner, and allow an increase of the inner space and further improved performance characteristics.

BRIEF SUMMARY OF THE INVENTION

The above purposes are achieved in that the control unit in accordance with the invention exhibits the characteristic features defined in the appended claims.

More specifically, the control unit in accordance with the invention is essentially characterised in that it comprises stop means designed to stop the movement of the weight in a direction outwards, away from the centre of the vessel athwartships so as to eliminate undesired movements of the weight. In order to distinguish a movement to the left at the left-hand side of the vessel from a movement to the left at the right-hand side thereof, a shifting device is used, said device permitting one of the stop means to become effective, i.e. to stop the weight movement, when the weight is on the left-hand side. When the weight is on the opposite side the second stop means is arranged to stop the weight movement. This function is initiated in that the weight, upon passing the centre line of the vessel as seen in the transverse direction thereof, resets the shifting device, for instance by resetting an actuating arm incorporated in the shifting device. When the weight is positioned to the left of the vessel centre, one of the stop means thus is capable of stopping the movement thereof whereas when the weight is to the right of the centre line the second stop means is arranged to stop the weight movement. Each stop means is actuated by at least one unit sensing the vessel movements, said unit being responsive above all to the inclination and lateral acceleration forces, such as the centrifugal force, of the hull 11. The vessel movements are affected primarily by the wind, the waves and the rudder effect upon turning. Because each sensing unit responds to conditions of inclination and lateral acceleration in the same way as does the weight, the sensing unit which has become effective in response to the position of the shifting device, is able to actuate its associated stop means to stop the weight movements, preventing the latter from moving further away from the vessel centre. The result is that the weight is only displaced away from the vessel centre to any essential degree by the effect from the mast movements, said effect normally being generated by the lateral pressure of the wind on the sails of the vessel. In other words, the mast may displace the weight outwards, in counter-direction to the direction of the wind during sailing, to provide the desired stabilizing effect. In contrast thereto, the weight will not be displaced laterally as the vessel turns or is exposed to lateral acceleration forces. Nor will the weight be displaced laterally when the vessel is tilted by the waves.

In accordance with a further developement of the invention, the stop means are provided with means arranged, when the associated stop means has been moved to its stop position, to prevent weight movements only in the direction outwards from the vessel centre line but not towards that line. In a hydraulic system, these means may be by-pass lines including check valves or, in a mechanical system, freewheel clutches for shafts. Through these arrangements, the weight can always move towards the centre of the vessel, which is desirable. If the vessel sails without pressure on the sails under rolling sea conditions, i.e. when the vessel rolls from side to side, the control unit will ensure that the weight moves to the centre position and remains there.

In accordance with one preferred embodiment, the control unit is composed of a hydraulic system. The system comprises a double-acting cylinder the piston rod of which, and consequently also the piston, is connected to the weight by means of e.g. control lines, ensuring that the piston rod moves as the weight moves, whereby a liquid flow is created in the hydraulic system. Two stop valves or stop means actuated by the sensing unit, and a shift valve or shift device are incorporated in the hydraulic system. When the weight is positioned to one side of the vessel centre line athwartships the shift valve connects one of the stop valves in an operative hydraulic circuit, allowing said stop valve to arrest weight movements. On the other hand, the second stop valve is disconnected from this operative hydraulic circuit. When the stop valve which is in the operative circuit is shifted to its stop position by means of the associated sensing unit, the weight movements are stopped, and the weight thus prevented from moving further way from the vessel centre line in the transverse direction of the vessel.

In accordance with a further development of the invention each stop valve is supplemented by a by-pass line which is equipped with check valves allowing fluid to pass the valve in one direction but not in the opposite one. Owing To this arrangement, the weight may move towards the vessel centre line also when the stop valve of the operative hydraulic circuit is closed. In this manner the weight can always move towards the vessel centre line.

In accordance with yet another development of the invention a valve having a flow throttling function is provided closely adjacent the associated stop valve. The throttle valve may be fixed or adjustable, allowing each valve to regulate the speed of movement of the weight outwards, away from the vessel centre.

In accordance with another further development of the invention a valve is inserted in each by-pass line, said valve having a fixed or adjustable flow throttling function, allowing each valve to regulate the speed of movement of the weight inwards, towards the vessel centre. Such regulation occurs in the flow path which is always open to flow corresponding to the weight movement inwards, towards the centre.

According to a further development a valve having a closing or cut-off function is provided closely adjacent its associated stop valve. When this valve is closed weight movements outwards away from the centre in the corresponding direction are prevented, irrespective of where the weight is positioned in the transverse direction of the vessel.

In accordance with yet another development of the invention each by-pass line is equipped with a valve having a closing or cut-off function, whereby the weight movements inwards towards the centre are prevented by way of the flow path which otherwise is always open to flows corresponding to weight movements inwards, towards the centre. This means that if all closure valve are closed, the weight is locked against athwartships movements, irrespective of its position in the transverse direction of the vessel.

BRIEF DESCRIPTION OF THE DRAWINGS

The invention will be described in closer detail in the following with reference to the accompanying drawings wherein the same numeral references have been used throughout all the drawing figures to define corresponding details. The vessel incorporateing the stabilizing system and the control unit is symmetrical with respect to a centre line through the vessel hull as seen in the transverse direction of the vessel. Components to the right of the centre line which are directly equivalent to those occurring on the left-hand side, are referred to by the same numeral with the addition of the sign '. For example, the control line on the right-hand side is referred to by 18' and on the left-hand side by 18. In the drawings.

DESCRIPTION OF DIFFERENT EMBODIMENTS

Figure 1:
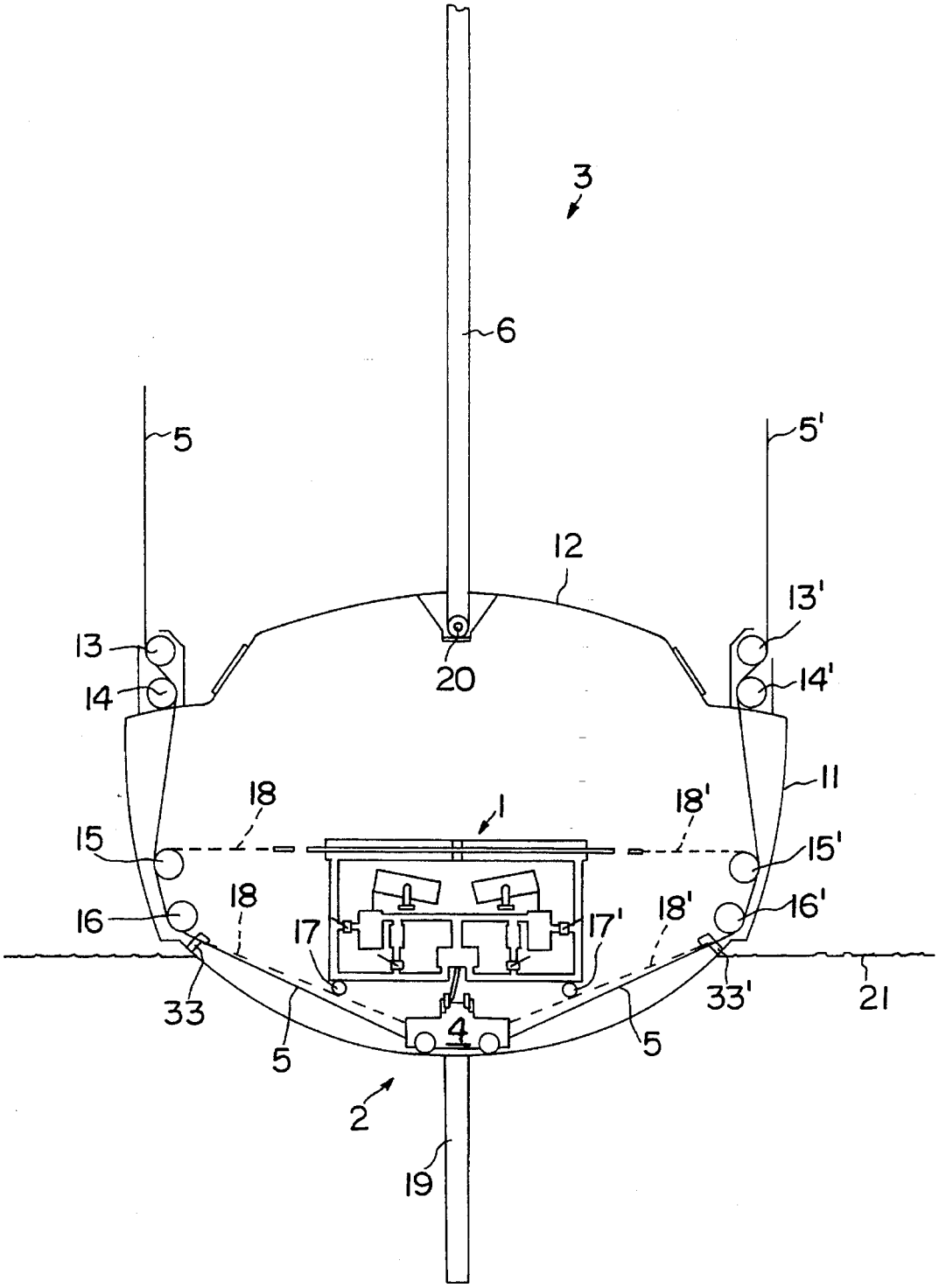
FIG. 1 is a cross-sectional view through the vessel in the transverse direction of the sailing vessel equipped with a control unit in accordance with the invention. The vessel is unaffected by wind or waves.

FIG. 1 illustrates in a cross-sectional view a sailing vessel or yacht 3 as seen from the rear. The vessel is completely symmetrical. The left-hand side thus is the port side and the right-hand side the starboard side of the vessel. On the starboard side numeral references with addition of the sign ' are used. The vessel floats on the water, the surface of which is designated by 21, and it is unaffected by winds and waves. In the conventional way, the vessel comprises a hull 11 with a deck and coach roof 12, a mast 6 and a keel or centreboard 19. The mast is stayed in the conventional manner lengthwise by stays aft and fore, which stays thus do not appear on the drawing figure.

In contrast to conventional sailing vessels, the sailing vessel in accordance with the subject invention is equipped with a stabilizing system the purpose of which is to eliminate or essentially reduce lateral heeling movements of the vessel during sailing. The stabilizing system essentially comprises a laterally tiltable mast 6, a weight 4 movable in the transverse vessel direction and a control unit 1. Note precisely, the mast 6 may be tilted laterally about an essentially lengthwise pivot shaft arranged in a mast step 20. The mast 6 is equipped with lateral stays adapted to the mast tiltability, more precisely in the form of shrouds 5, 5' which by means of blocks 13–17 and 13'–17' interconnect the mast 6 and the weight 4. Briefly, the purpose of the control unit is to prevent the movable weight from performing undesired movements. In order to conter-act drift, a keel 19 or a centreboard 19 is used in the conventional manner. Depending on the intended usage of the vessel, the weight of the keel or centreboard could vary within extensive limits. A centreboard is arranged to be completely or partly lifted or pivoted.

The movable weight 4 together with the tiltable mast 6 create lateral stabilization of the vessel hull 11 so as to ensure that it does not, as a rule, heel during sailing, or also that when the sailing conditions are more extreme, it heels to a considerably less extent than is the case with conventional sailing boats. This goal is achieved in two ways. Because of the tilt of the mast, the mast heeling effect on the hull is reduced, and because the movable weight as a result is displaced outwards, counter to the direction of the wind, a force, counter-acting the heeling-over force from the sails is created already when the vessel does not heel at all.

Normally, the weight 4 forms a considerable part of the total weight of the vessel. In a protocype vessel, it is 2.5 tons of the total weight of 7.9 tons. This vessel, which has a length of 11 meters and a width of 3.70 meters, has performed in a most trustworthy and reliable manner under a number of most varying sailing conditions. In the following the weight 4 will be referred to as the component weight. In accordance with the preferred embodiment, the weight rolls along a track extending athwartships. It is retained in the track in such a manner that it cannot be dislodged therefrom either in an upwards direction or in the lengthwise direction of the vessel. Should this be allowed to happen, the weight could have seriously endangered the safety of crew and vessel. It goes without saying that the weight 4 could be mounted in other ways, provided the safety requirements are met. For instance, it could be suspended as a pendulum inside the hull or be placed on wheels having a vertical axis of rotation. However, solutions of this kind require more space and are impractical compared with the shown solution. In addition, the movable weight 4 could be attached to the lower end of a pivotable arm which is suspended from and below the vessel. In this case, the arm is mounted close to the vessel bottom and is positioned ahead of or to the rear of the vessel keel or centreboard. The shrouds 5, 5' then act on the upper end of the arm in such a manner that the weight at its lower end is displaced outwards, counter to the direction of tilting of the mast. This could be effected for instance by carrying the shroud 5 via blocks over to the opposite side of the vessel to actuate the arm from the right-hand side of the vessel. Similarly, the shroud 5' is carried over to the left-hand side of the vessel. It is likewise possible to use a doubled-arm lever to actuate the upper face of the arm whereas the shrouds 5, 5' are arranged to actuate the opposite side of the lever, and in this case no reversal of the traction of the shrouds 5, 5' is required. The subject invention concerns the control unit 1 in the stabilizing system 2 and the means of attachment of the weight is of less importance to the function of the control unit.

Figure 2A:
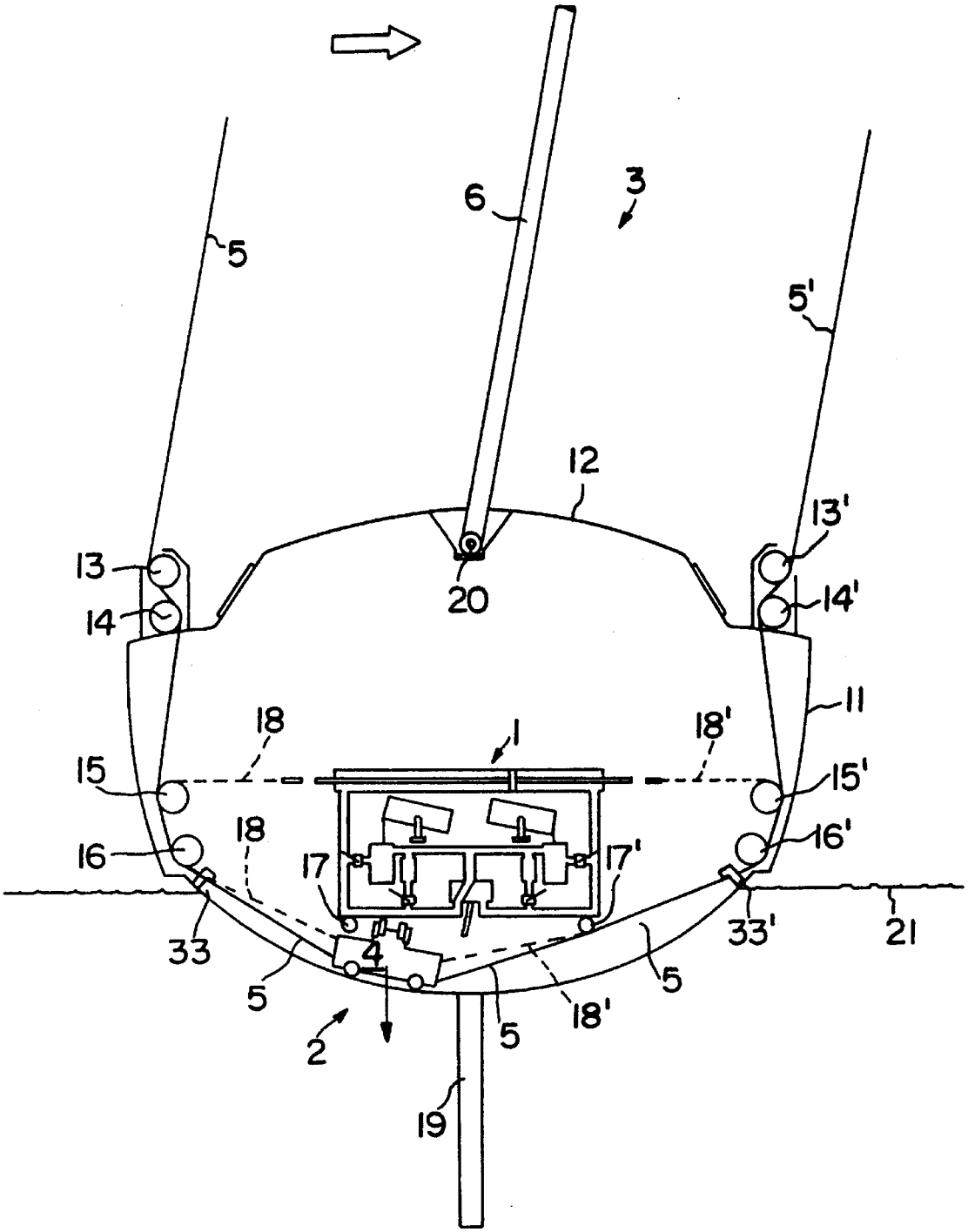
FIG. 2A is a cross-sectional view corresponding to FIG. 1 but shows the conditions when the vessel is affected by a light breeze from the left.
Figure 3:
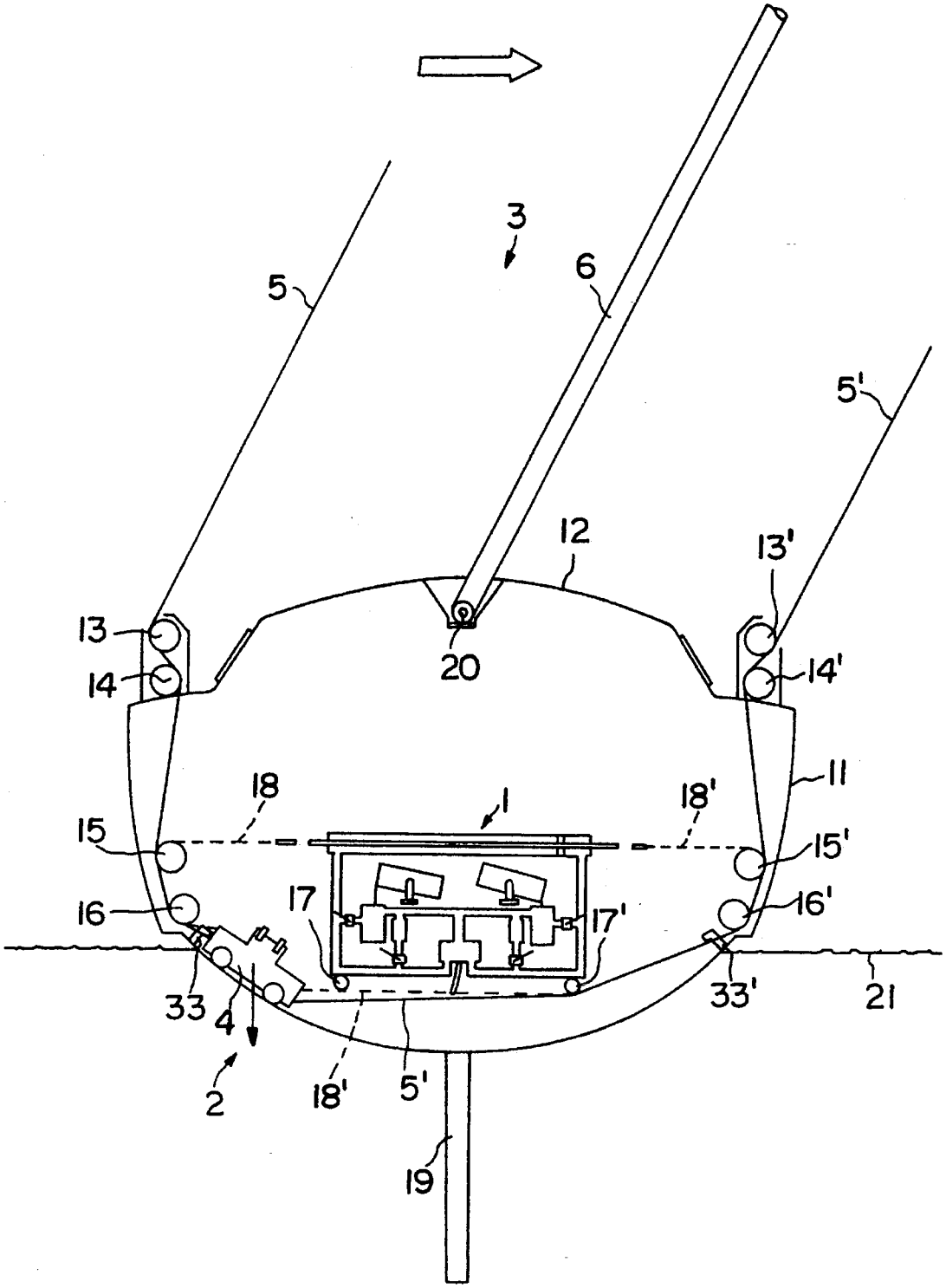
FIG. 3 illustrates the mode of operation of the stabilizing system when exposed to stronger winds than in accordance with FIG. 2A. The movable weight has just reached one side abutment means.
Figure 4:
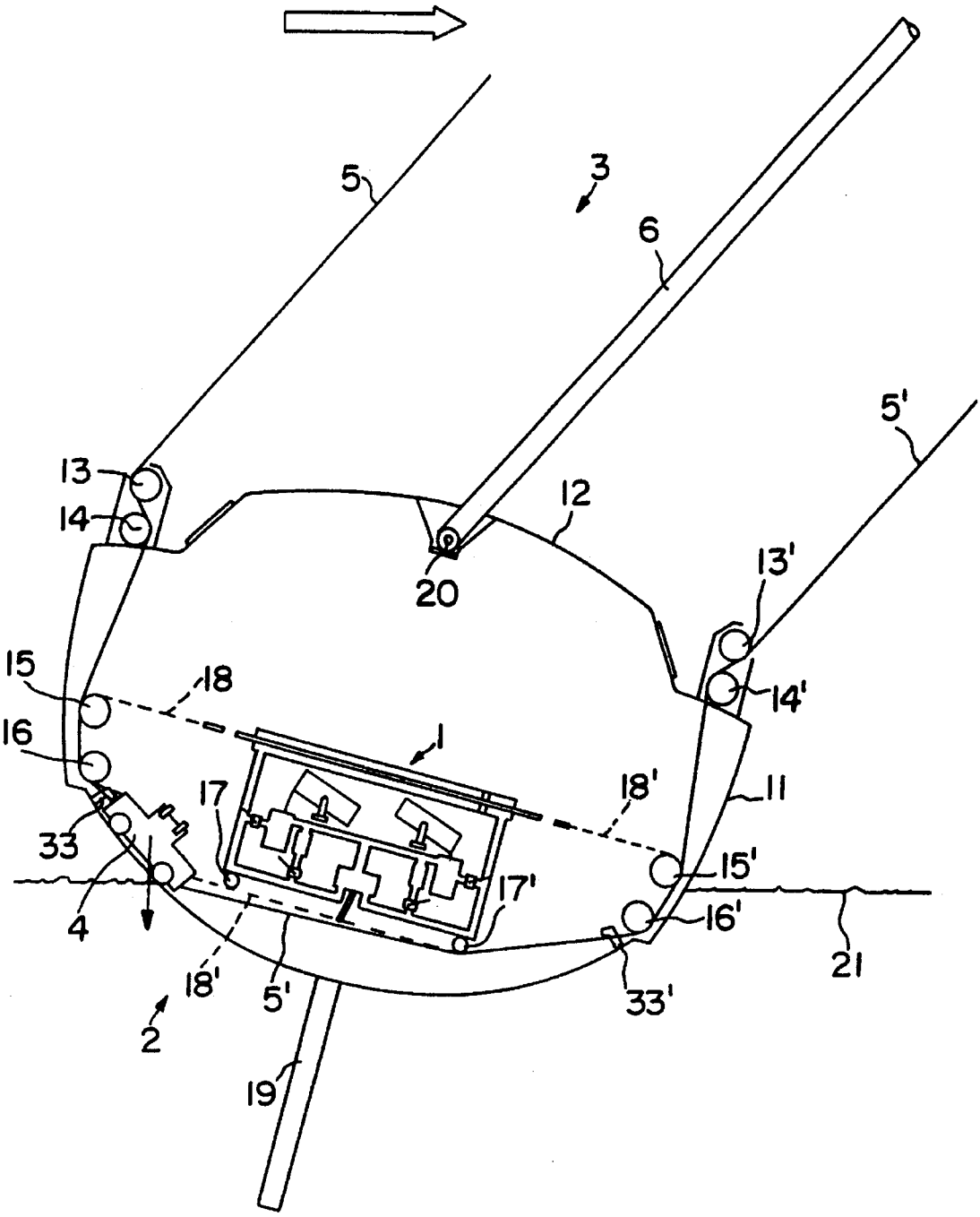
FIG. 4 illustrates the reaction of the vessel when exposed to yet stronger winds than in FIG. 3.

FIGS. 2A, 3 and 4 illustrate more clearly the function of the sailing vessel stabilizing system. FIG. 2A illustrates the situation when the vessel is affected by a comparatively light breeze from the port side whereas FIG. 3 refers to the situation when the vessel is sailing in comparatively strong winds and FIG. 4 in very strong winds. In FIG. 2A, the mast tilts somewhat towards the starboard side of the vessel and the component weight 4 has been pulled by the shroud 5 over a correspnding distance from the centre line of the vessel. The wind force acts on the vessel sails and the latter cause the mast to adopt a tilting or inclined position. As a result, a pulling force is exerted on the shroud 5 which will cause the hull 11 to heel but the position of the component weight generates a counter-acting force tending to cause the vessel to heel in the opposite direction. By carefully balancing the construction of the system the vessel will sail without practically any heeling-over at all.

In FIG. 3, the wind is rather strong, as indicated by the longer wind-force indicating arrow. This drawing figure illustrates the situation when the component weight has just arrived to an end position abutment means 33, stopping its movement. Thus, it cannot move further outwards laterally and the mast cannot increase its tilt. By suitable tuning of the system the vessel will also in this case sail without practically any heeling-over. The considerably stronger wind power is balanced by the increased moment from the component weight in relation to the vessel centre line.

In FIG. 4, the wind is stronger still. Since the mast 6 and the component weight 4 have already reached their extreme positions, they cannot move any further. Instead, the hull 11 starts to heel. However, this heel is considerably smaller than in a corresponding conventional sailing vessel under similar conditions. As some examples of these results could be mentioned those obtained with heeling tests carried out with the prototype vessel. The latter was made to heel-over by the application of a heeling-over force on the vessel mast in the conventional manner. The tests were carried out with the stabilizing system in operation as well as with the stabilizing system disconnected. In the latter case, the component weight and the mast were locked in position in alignment with the vessel centre line. With the means set in this position, the vessel is as stiff and more, as a conventional sailing vessel from a stabilizing point of view. This is a result of the unusually large shape stability of the vessel owing to its large maximum width and its extremely large transom width. This configuration is possible precisely because the stabilizing system eliminates or heavily reduces the vessel heel-over movements. During the heeling-over tests corresponding to the situation of FIG. 3, the mast tilt is 35° in the sailing vessel in accordance with the invention whereas the hull remains completely horizontal. In conventional vessels the corresponding values are 35° with respect to both the mast and the hull heeling, i.e. the same value as the mast in FIG. 3. As a matter of fact, the prototype vessel is tuned to a mast tilt approximately corresponding to that of a conventional sailing vessel. During the heeling-over tests corresponding to the situation of FIG. 4 the hull heels 9° and the mast an additional 35°, i.e. a total of 44° with respect to the vertical. Corresponding heeling in conventional vessels is about 50°, i.e. a heeling-over that is larger by 40°. This means that in stronger winds heeling is reduced by about 35°–40°. Obviously, this is an important advantage considering the comfort and the safety on board.

The examples of FIGS. 2A, 3 and 4 relate to heeling when the wind force acts from the port or left side of the vessel. Since the stabilizing system is entirely symmetrical it will function in exactly the same manner when the winds come from the opposite side and consequently this situation is not illustrated. The same is true concerning the operation of the control unit 1, and in the following only heeling and inertia forces from one side will be described.

Having thus described the general function of the stabilizing system the construction and the function of the control 1 unit will now be described in closer detail. In accordance with the preferred embodiment, the unit is constructed from hydraulic components but it could equally well be of mechanical or electro-mechanical construction. The control unit 1 is connected to the component weight 4 by means of control lines 18, 18'. The line 18 is attached to the left-hand side of the component weight 4 and extends via at least one block 15, 16 to the left-hand end of a piston rod 22 in a double-acting hydraulic cylinder 24. The blocks 15, 16 are formed with one groove to receive the shroud 5 and one groove for the control line 18. Obviously, separate blocks could be used for the control line 18. In a corresponding manner, the control line 18' runs from the right-hand side of the weight 4 via blocks 15', 16' to the right-hand end of the piston rod 22. In accordance with FIG. 4, the control lines 18, 18' are partly obscured by the shrouds 5, 5'. Normally, the control unit 1 is placed symmetrically with respect to the centre line of the vessel. In this case the piston rod 22 has a centrally located piston 23. In FIG. 1, the piston 23 as well as the weight 4 and the mast 6 thus are aligned with the vessel centre line. In FIG. 2A, the component weight 4 has moved To the left and via the control line 18' it has pulled along the piston rod 22 and the piston 23 thereof to the right. This results in hydraulic fluid from the right-hand side of the hydraulic cylinder 24 will be forced into the line system and via the latter it will be forced back to the left-hand side of the cylinder. In other words, the movement of the weight creates a fluid flow through the line system. By stopping this flow and consequently the piston rod movements, the weight 4 can be stopped, the reason therefor being that it is securely connected to the piston rod 22 via the control line 18, 18'.

Figure 2B:
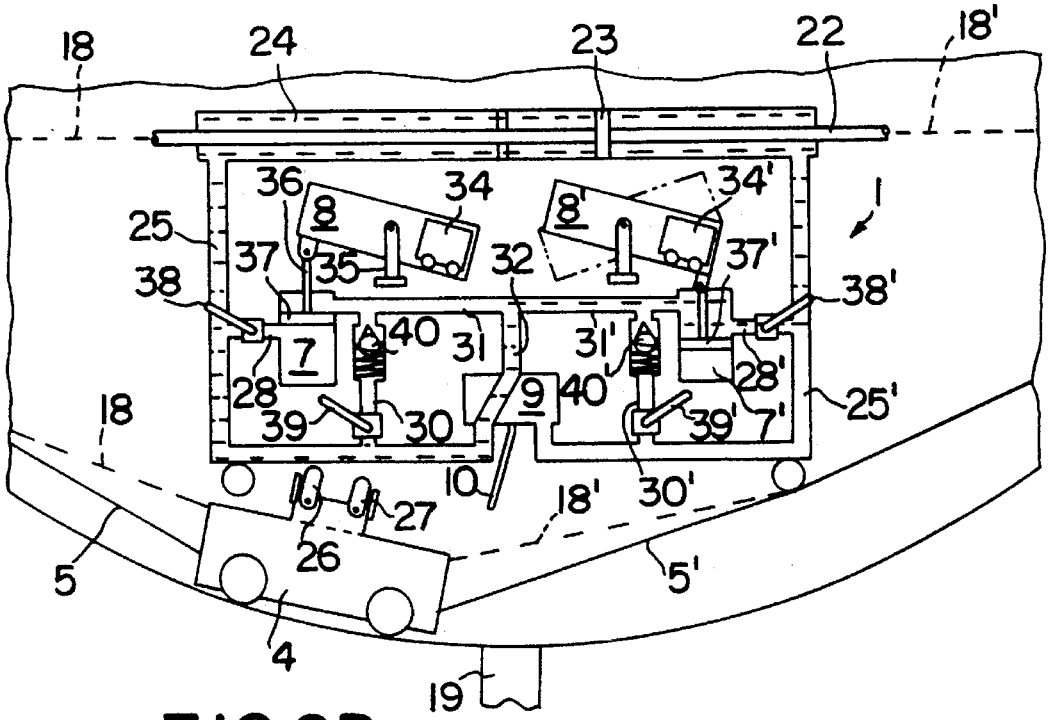
FIG. 2B illustrates in a considerably enlarged view the control unit of FIG. 2A and adjacent components.

FIG. 2B shows part of FIG. 2A in an enlarged view. The line system consists of a series of lines through which the medium flows according to different patterns depending on the different operative conditions. From the left-hand end of the cylinder 24 the left cylinder line 25 leads to a shifting device or shift valve 9. In a corresponding manner the right-hand cylinder line 25' extends from the right-hand side of the cylinder to the shift valve 9. The shift valve 9 is provided with an actuating arm 10 which is affected by finger-like actuating members 26 and 27, mounted on the weight 4, as the weight passes the vessel centre line. The left-hand cylinder line 25 has a branch line, left branch line 28 which leads to the left stop means or left stop valve 7. In a corresponding manner the right-hand branch line 28' leads from the right-hand cylinder line 25' to the right-hand stop valve 7'. From the left stop valve 7 a left communication line 31 leds to a centre line 32 leading to the shift valve 9. In the same manner, the right-hand communication line 31' leads from the right-hand stop valve to the centre line 32. The left by-pass line 30 leads from the left communication line 31 to the left cylinder line 25 and in a corresponding manner the right-hand by-pass line 30' extends from the right-hand communication line 31'.

The left sensing unit or rocking member 8 actuates the left stop valve 7. The sensing unit 8 is in the form of a rockable member which has a mounting means 35 about which it may pivot. Inside the rocking member 8 the left rocker carriage 34 is positioned. In other words, the carriage is arranged to roll inside the rocker member. Instead of a carriage a heavy ball may be used. The weight of the carriage 34 depresses the end of the member occupied by the carriage at any particular moment. In the case illustrated this means that the left rocker piston rod 36 has been extended to its maximum extent from the left stop valve 7. Accordingly, the left rocker piston 37 is in a position wherein it interrupts the communication between the branch line 28 and the communication line 31. The right-hand stop valve 7' and the right-hand sensing unit or rocker member 8' are constructed in a corresponding manner. In the position illustrated, the right-hand rocker carriage 34' has depressed the right-hand rocker piston 37', whereby the latter will be positioned below the branch line 28'. Consequently, medium may flow freely between the branch line 28' and the communication line 31'. In the left branch line 28 a manually operated valve 38 is positioned and in a corresponding manner a valve 38' is inserted in line 28'. In the left by-pass line 30 a manual valve is inserted and in the corresponding manner a manual valve 39' is inserted in line 30'. Normally, the manual valves 38, 38', 39, 39' are all alike and are intended for closing and throttling operations. This may be effected e.g. by equipping a cut-off valve with a stationary throttling plate. Naturally, two valves in sequence may be used, one cut-off valve and one adjustable throttling valve. For the sake of simplicity the closing and throttling functions are shown as existing in one and the same valve. In addition, the by-pass lines 30, 30' are provided with non-return valves 40, 40', respectively. These non-return valves allow flows from the top and downwards as seen in the figures, i.e. from the associated communication line 31, 31' to the associated cylinder line 25, 25'. Flows in the opposite direction, on the other hand, are prevented.

With reference to FIGS. 2A aand 2B the function of the hydraulic control unit 1 will be described. Assuming that from an initial position as illustrated in FIG. 1 a light breeze starts to blow from the port or left side. In consequence thereof, the shroud 5 starts to exert a pulling force on the weight 4 via the blocks 13–17. Via the control line 18, the weight starts to exert a pulling force on the piston rod of the hydraulic cylinder. In FIG. 2B the initial position corresponding to that of FIG. 1 is indicated in dash-and-dot lines as concerns the rocking member 8' and the piston 23. The pull on the control line 18' thus will displace the piston indicated in dash-and-dot lines to the right. This displacement requires liquid flow out of the cylinder 24 through the line 25' and back into the cylinder at the left-hand side thereof through line 25. The weight 4 then is positioned in alignment with the vessel centre line, a position which for the sake of clarity is not illustrated in the drawing figure. In one of the positions, e.g. the one illustrated, the shift valve actuating arm 27 is effective to set the shift valve 9 for interconnection of lines 32 and 32, whereas in the other position, not illustrated, it serves to "interconnect" line 32 and line 25'. The shift valve 9 and the actuating arm 10 are conceived to ensure that the shifting occurs more or less instantaneously while at the same time there is some play in the system preventing the system from being locked in the centre position. Assuming, initially, that the actuating arm 10 is positioned as illustrated in FIG. 2B. In this position, hydraulic fluid cannot flow from line 25' into line 32. In addition, the non-return valve 40' prevents fluid flow in line 30'. In the position of the rocking member 8' illustrated in dash-and-dot lines the right-hand stop valve 7' is precisely in a stop position wherein no flow can occur between line 28' and line 31'. This flow blockage corresponds to the hatched parts in FIG. 2C. This means, of course, that the weight 4 will be maintained in its original position in alignment with the vessel centre line. The light breeze therefore causes the hull to heel in such a manner that it is at a few degrees of heel the clockwise direction. This will make the right-hand rockable carriage 34' to roll over to the right-hand side and the rocking member 8' shifts its position into the one illustrated in full lines in the drawing figure. In the drawing figure, the inclination of the rocker members 8 and 8' is strongly exaggerated for more clarity In reality, their inclination is only about 1°–2°, and consequently each carriage 34, 34' rolls easily from one end position to the other as the vessel starts to heel The vessel in FIG. 2A sails without heeling-over. It has earlier heeled somewhat in the direction of the wind, causing the rocking members 8 and 8' to move to the position indicated. This is repeated upon each tack against the wind. Because of the shift of position of the rocking member 8' to the one illustrated in full lines the communication between the line 28' and line 31' is now open. This means that fluid from line 25' can flow this way in order to flow from line 31' down through the centre line 32 and through the shift valve 9 to the left-hand cylinder line 25. Consequently, the piston 23 may move from the position indicated in dash-and-dot lines to that illustrated in full lines in the drawing and corresponding to the position of the weight. The through-flow is indicated in FIG. 2B by hatching of the relevant path of flow. Should the wind increase, as in FIG. 3, such movement continues. The piston 23 then travels further to the right and the weight 4 to the left. Since the weight 4 then just abuts against the left-hand end abutment 33 its movement is stopped in an extreme position. At the same time the piston rod 22 and its piston 23 are stopped in a right-hand extreme position. Normally, the sails are reefed under such heavy wind force conditions. Heeling-over of the hull 1 thus can be avoided, also at even stronger wind forces. Should the wind increase further as in FIG. 4, consequently no fluid through-flow occurs in the control unit 1. On the other hand, if the wind abates below the position corresponding to FIG. 3, the weight will travel back, towards the centre, and the mast will straighten up. The valves 7 and 7', the rocking members 8 and 8' and the valve 9 assume the positions in accordance with FIG. 2B. This means that when the piston 23 moves to the left, fluid will flow through the line 25 via the shift valve 9, the centre line 32, the right-hand communication line 31', the right-hand stop valve 7', the right-hand branch line 28' to the right-hand cylinder line 25' and into the cylinder 24, i.e. it will follwing the path of flow indicated by hatching.

In the following, the function of the control unit to prevent undesired movements will be described. Assuming that the vessel in accordance with FIGS. 2A and 2B is sailing forwards and suddenly turns sharply towards starboard, i.e. to the right. This means that centrifugal forces will act on the vessel, and particularly on the components thereof that are movable athwartships, i.e. the component weight 4, the mast 6 and the two rocker carriages 34, 34'. Since the weight 4 is a great deal heavier than the mast 6, the weight will tend to travel outwards as a result of the turning movement, i.e. in the direction towards its end abutment 33. But also the two carriages 34, 34' are affected by the lateral acceleration force imparted by the turn to the right and will roll to the left upwards, along the slight slope of each rocking member 8, 8'. Both rocking members thus will change their positions, in consequence whereof the stop valve 7' will close and stop valve 7 open. Because of the closure of valve 7' no fluid can flow from line 25' to line 31' and via line 32 and shift valve 9 and line 25 back to the cylinder 24. In addition, the non-return valve 40' prevents the fluid from instead flowing in line 30', and the shift valve 9 is of course closed to fluid from line 25'. Consequently, no fluid can flow from the right-hand side of the cylinder 24 to its left-hand side and therefore the movement of the piston rod 22 is stopped and in consequence thereof that of the associated component weight 4. This flow blockage corresponds to the situation indicated by hatching in FIG. 2C. In this manner undesired movements of the component weight 4 thus has been avoided, for if the weight 4 could have moved further outwardly, the vessel would have started to heel outwards in a most uncomfortable way when turning sharply.

Assuming instead that a large wave were to approach in the direction of the wind and hit the vessel sidewise, forcing the vessel to the right in accordance with the drawing figure. The same sequence of events will occur as in the previous example. The lateral acceleration to the right will bring the rocker carriages 34, 34' to roll to the left, resulting in closing of the active stop valve 7' with consequential prevention of the piston rod and weight movements in the same manner. The fact that the left stop valve 7 opens is of no importance in this connection, since the fluid cannot reach it because the shift valve 9 is in the indicated position. This position always results from weight positions to the left of the vessel centre line. This means, therefore, that when the weight is to the left of the centre line, only the right-hand stop valve 7' and the right-hand sensing unit or rocking member 8' are active.

Assuming instead that from the original position in FIGS. 2A, 2B, the vessel turns sharply to the left. In this case, the carriages 34, 34' want to move to the right, i.e. to the position they already assume in FIG. 2B. The indicated hatched path of flow, i.e. via components 25, 32, 31', 7', 28', 25', thus is open and the weight 4 may move inwards, towards the centre line. The actuating finger-like members 26, 27 are placed symmetrically about the centre line of the weight 4 and they are both made to pivot inwards, towards the weight centre line, in response to a light spring force. In other words, the right-hand actuating finger 27 will always pivot downwards so as not to affect the actuating arm 10 but go clear of the latter. On the other hand, the two fingers are arranged so as to be preventing from pivoting outwards, away from the centre line of the weight 4, and consequnetly, when the weight continues to the right the left actuating finger will bring along the actuating arm 10 to the left. As a result, the shift valve 9 will instead communicate line 25' with line 32. The communication between lines 25 and 32 thus is interrupted. Since the stop valve is closed and the non-return valve 40 prevents fluid flow through line 30, the flow is blocked, and the weight has been stopped near the vessel centre line. Had it continued outwards to the right, this would have resulted in the vessel heeling-over outwards most uncomfortably as the vessel turns. Instead of the solution illustrated involving the actuating fingers 26, 27 to act on the actuating arm 10 another solution could be adopted. In this case the actuating operative stroke is in the lengthwise direction of the vessel and the weight 4 is provided with a groove in which the actuating arm 10 travels. The groove runs diagonally across the weight and thus a shift of the flow path occurs when the weight passes the centre position. This solution is more simple in some respects than the shown one but is not equally illustrative in the drawings.

Figure 2C:
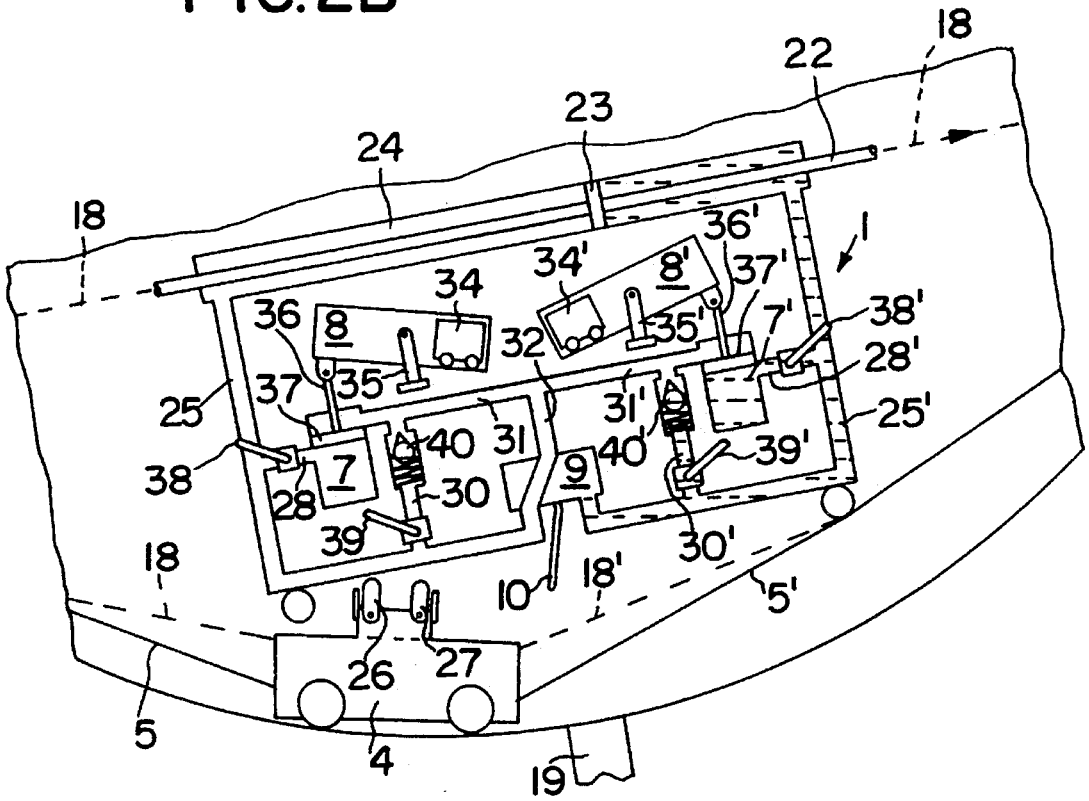
FIG. 2C illustrates the control unit in accordance with FIG. 2B when influenced by a heel to the left.
Figure 2D:
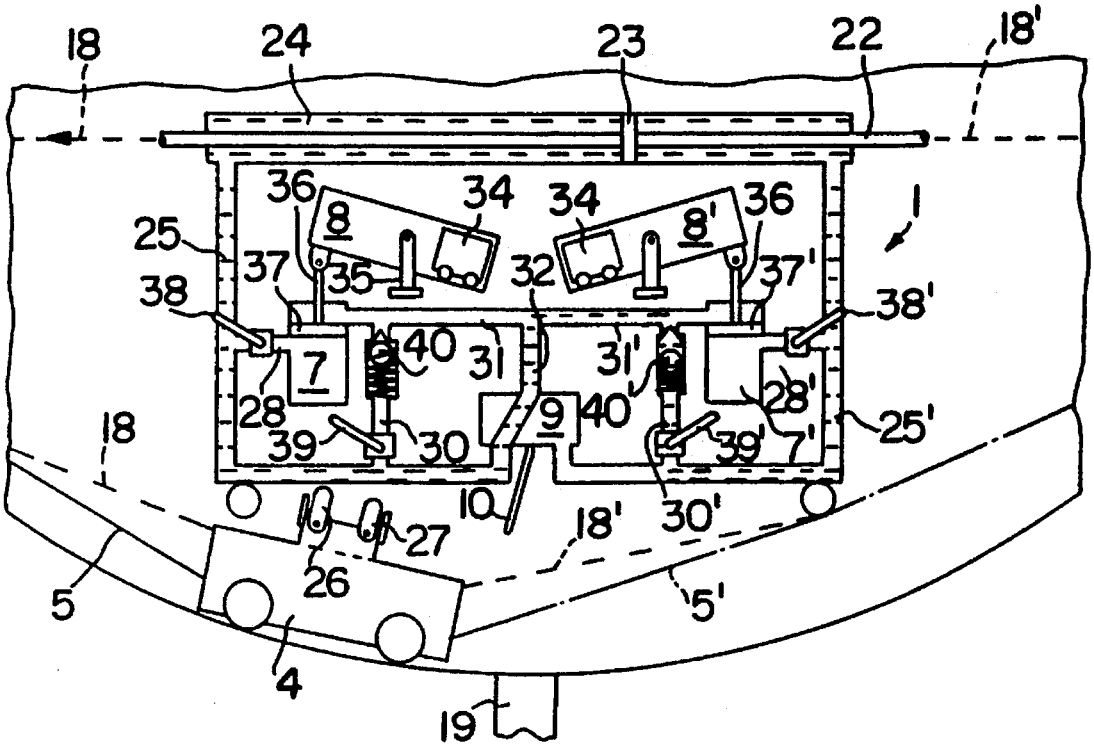
FIG. 2D illustrates weight movements inwards towards the vessel centre as a result of flow through a by-pass line.

Assuming further that from the original position of FIGS. 2A, 2B the vessel is affected by a wave tilting the vessel to the left, as illustrated in FIG. 2C. The carriages 34, 34' then want to roll to the left. In the illustrated position, carriage 34' has just rolled to its opposite position, causing closure of the stop valve 7'. On the other hand, the carriage 34 has not yet rolled in the opposite direction, as will be explained later on. Consequently, the right-hand stop valve 7' is closed and as a result the connection between line 28' and line 31' is interrupted and the non-return valve 40' prevents flow through line 30'. Since the weight 4 and the actuating arm 10 are to the left, through-flow from line 25' to the centre line 32 cannot either occur. Thus, the flow is blocked, which is illustrated by the hatching in FIG. 2C. Also the piston rod and consequently the weight 4 are locked in the illustrated position. This means that the weight cannot roll further outwards from the centre line and thus a non-desired movement of the weight has been prevented. Imagining that the vessel now starts to tilt back to the horizontal position the weight will move inwards, towards the centre position. This will be so at least if the wind is not sufficiently strong to maintain the weight in the outer position with the aid of the wind force imparted by the sail on the mast. As shown, the communication via line 25 and shift valve 9 is open. Stop valve 7', on the other hand, is closed and will remain so until the boat has rolled over a few degrees in the opposite direction, i.e. to the right. But thanks to the right-hand by-pass line 30' the flow can be routed past the non-return valve 40' and to the right-hand cylinder line 25'. In FIG. 2D, this flow path is hatched. Owing to the use of by-pass lines 30, 30' equipped with the non-return valves 40, 40', the weight thus can move inwards, towards the vessel centre line, already when the vessel does not tilt to the opposite side. In FIG. 2D is shown, in exaggeration, how the ball of the none-return valve has been forced backwards, allowing passage from line 31' to line 25'.

An operational situation that occurs frequently is travelling by motor with the vessel in heavy sea. In this case, the vessel will roll from side to side, i.e. it will heel to the left, to the right, to the left, and so on. Owing to the solution illustrated involving the by-pass fines 30, 30', the weight will tend to move towards the vessel centre line. However, if the weight is again to be able to move in either direction away from the centre line of the vessel, it is necessary that a corresponding stop means is opened. This does not happen, however, since the vessel heeling motion will instead cause the corresponding stop means to close. Consequently, the weight will remain aligned with the centre line as the vessel rolls in heavy sea. In principle it would be possible, in situations when the heel is small, to arrange for the weight to be affected earlier than the associated rocking member 8, 8'. This could then result in very minute movements of the weight about the centre line of the vessel. Possibly, this could be felt to be a flaw in the system. In order to counter-act this it is possible to design the rocking member geometry in such a manner that the closed position is given some priority over the open one. This could be achieved for instance by arranging for the rocking member to tilt more steeply in the closed position than in the open one. Another solution is to bias the rocking members towards the closed position of the associated stop valve, which position thus takes priority. In this manner, the stop means 7, 7' will assume the closed position illustrated in FIGS. 1, 2C, 2D when the rolling movements are small.

It is important to point out that both by-pass lines 30, 30' are not required in order to achieve the basic function of the invention, i.e. to prevent undesired movements of the weight 4. Forces tending to act on the weight so that the latter will perform undesired movements outwards, away from the vessel centre line, also affect the associated sensing unit 8, 8'. The sensing unit that could allow such a movement outwards, away from the centre line, is closed and the movement is prevented. Because the sensing units are provided with rocker carriages 34, 34' they will be affected by external movements in the same way as the weight. In an efficient manner, the control unit thus can prevent undesired movements. In accordance with the embodiment illustrated the sensing units are entirely mechanical rocking means including rolling carriages but naturally they could also be designed in other ways, provided that the desired function is obtained. The shown solution does not require any supply of additional energy to function but naturally the principles of the invention may be made use of also in systems that are supplied with additional energy. For instance, it is quite possible to arrange the stop valves 7, 7' as electrically controlled valves which are governed by their respective one of sensing units 8, 8'. Also in this case each sensing unit is designed to be affected by tilting and inertia forces. Each stop valve could then be arranged to be opened by a electro-magnet in one position and to be closed in the opposite position by spring force, for instance. Because by-pass lines 30, 30' are used, earlier return of the weight to the vessel centre line is obtained, i.e. a refined function.

Furthermore, the system provides a possibility to throttle the speed of the weight movements in various ways by making use of various flow paths. Imagining intially the case when the wind first becomes stronger, i.e. a change from the situation in FIG. 2A, to that of FIG. 3, and then again weakens, i.e. a change back to the situation in FIG. 2A. In this case the hatched path of flow of FIG. 2B will apply and the throttling is in the valve 38'. As the wind increases, fluid will flow through valve 38' in one direction as the weight 4 moves outwardly to the left whereas as the wind weakens, the fluid flow through the valve will be in the opposite direction, as the weight 4 moves to the right. It is suitable that the throttling in valves 38, 38' is comparatively small in order to allow rapid moving outwards of the weight 4 and consequently rapid reduction of the heeling-over of the vessel. In sailing with the wind coming from the opposite side, i.e. from the right, it is instead valve 38 and the throttling thereof that is operative. Upon small rolling movements backwards and forwards in accordance with FIGS. 2C and 2D, on the other hand, the weight returns towards the centre line position in that a flow path via the right-hand by-pass line 30' is used. This flow path appears from FIG. 2D. In this case, fluid passes through valve 39' instead, which valve has its own throttling. This movement of the weight could be throttled to a larger or smaller extent in comparison with the previous case.

In addition, a valve 38 having a closing function is inserted in the left branch line 28, as also a valve 38' with the same function, in the right-hand branch line 28'. As the respective valve is closed weight movements outwards, away from the centre, are prevented in the corresponding direction. For instance valve 38' prevents movements of the weight 4 outwards to the left. If both valves 38, 38' are closed the weight therefore will strive towards the vessel centre with the aid of flow in the by-pass lines 30, 30', provided the vessel movements provide sufficient drive to move the weight.

In each by-pass line 30, 30' there is a valve 39 and 39', respectively, having a closing function. As these are closed the weight consequently is prevented from moving towards the vessel centre by means of flow in the associated by-pass line. This means that if all closing valves 38, 38', 39, 39' were to close, the weight is locked in position in the transverse direction of the vessel, irrespective of its position athwartships.

It is further important to note that the control unit 1 is shown in the drawing figures as being considerably larger than it really is in the vessel, which enlargement has been done in order to create clear drawing figures. For purposes of clarification the hydraulic system components therefore are spaced apart and the size of most of the components has been exaggerated. Actually, the control unit 1 is a great deal more compact than the drawing figures leads one to believe. Since the movable weight 4 follows the bottom contour it occupies very little space and the blocks 17, 17' keep the shrouds 5, 5' and the control lines 18, 18' down to thus reduce the space requirements of the stabilizing system.

It lies within the scope of the present invention to design the control unit in a different way from that shown. Obviously, the lines could be drawn and the components be positioned quite differently from that shown as also the configuration of the sensing units and the stop valves could be modified. The control unit could likewise be completely mechanical. For instance, stop means 7, 7' could be devised as rotating units driven by the associate control line or control chain which is carried about them. Each stop means is associated with a sensing means which is able to stop the rotary motion of the stop means. In a corresponding manner as in the hydraulic system a shifting means is provided which disconnects one of the stop means from effecting its stopping function when the weight occupies a position on one side of the vessel centre line and reversely, when the weight is on the opposite side of the centre line, it disconnects the other stop means. In this manner undesired movements outwards away from the centre line can be stopped. If in addition each stop means is provided with a free wheel clutch the weight may move inwards with the aid of the clutch. This function corresponds to the function of the by-pass lines 30, 30' in the hydraulic system. Also other purely mechanical solutions obviously are possible within the scope of the basic idea and principle of the invention.

We claim:

1. A control unit (1) incorporated in a stabilizing system (2) in yachts (3) and sailing vessels (3), said unit designed to automatically control the movements of a weight (4), which is movable transversely across the vessel, said weight (4) being connected with a mast (6) of a kind that is tiltable athwartships, in such a manner that the weight (4) is displaced transversely across the vessel in a direction opposite to the mast tilting direction, characterized in that the control unit (1) comprises a first and a second stop means (7, 7'), for example stop valves (7, 7'), designed to stop the movement of the weight (4), and further comprising a shifting device (9), such as a shift valve (9), which is actuated by the position of the weight (4) in such a manner that the first stop means (7) is given an opportunity to become effective, i.e. to stop the movement of the weight (4), when the weight (4) assumes a position to one side of the centre line of the vessel in the transverse direction thereof, whereas the second stop means (7') is then not given an opportunity to stop the movement of the weight (4), and when the weight (4) assumes a position to the opposite side of the centre line of said vessel centre line the shifting device (9) assumes a position wherein the situation is the reverse as concerns the stop means (7, 7'), i.e. the second stop means (7') is given an opportunity to stop the weight movements but the first stop means (7) is not, each stop means (7, 7') being actuated at least by its respective one of a first sensing unit (8) and a second sensing unit (8') which are responsive to-vessel movements, said sensing units being responsive primarily to the tilt and lateral acceleration forces, e.g. the centrifugal force, of the hull (11), whereby when the one of the stop means (7, 7') that has an opportunity to stop the movement of the weight (4) is moved by the associated sensing unit to a stop position the movement of the weight (4) is stopped, preventing the latter from moving further outwards, away from the centre line of the vessel athwartships, with the result that the weight (4) is essentially prevented from performing undesirable movements caused by the movements of the vessel in the water.

2. A control unit as claimed in claim 1, characterized in that each stop means (7, 7') is supplemented with means arranged, as the associated stop means (7, 7') has been moved to a stopping position, to stop movement of the weight (4) only in the direction away from the vessel centre line but not in a direction towards the vessel centre line, said means being e.g. by-pass lines (30, 30') including non-return valves (40, 40') in a hydraulic system, or else free-wheel clutches for shafts in a mechanical system.

3. A control device as claimed in claim 1, characterized in that the unit is constructed from a hydraulic system comprising a double-acting cylinder (24) the piston rod (22) and thus also the piston (23) of which are connected to the weight (4) by means of for instance control lines (18, 18') in such a manner that the piston rod will move when the weight moves and thus a flow of fluid is created in the hydraulic system, and a first and a second stop valve (7, 7') which are actuated by a first and a second sensing unit (8, 8') and a shift valve are included in the hydraulic system in such a manner that when the weight (4) is positioned to one side of the vessel centre line athwartships, e.g. to the left side, the shift valve (9) will cause the second stop valve (7') in an operative hydraulic circuit (25', 28', 7', 31' 32, 9, 25) to be connected whereas in this case the first stop valve (7) is not part of said operative hydraulic circuit, wherein flow from one side of the cylinder to the other one must occur, when the weight is to move outwards, athwartships, such that when the second stop valve (7'), which is in said operative hydraulic circuit, is displaced by its associated sensing unit (8') to a stop position, the movement of the weight (4) is stopped, so that the weight is prevented from moving further away outwards from the vessel centre line athwartships, and, if the weight instead assumes a position on the opposite side of the vessel centre line, i.e. the right-hand side, a hydraulic circuit (25, 28, 7, 31, 32, 9, 25') now becomes operative and the function becomes entirely analoguous, owing to the symmetrical construction of the system.

4. A control unit as claimed in claim 1, characterized in that each stop valve (7, 7') is supplemented with a by-pass line (30 and 30', respectively), each provided with its respective non-return valve (40 and 40', respectively), whereby flow is allowed past the associated stop valve (7, 7') in one direction but not in the opposite one and consequently the weight (4) can move towards the vessel centre line athwartships also when the stop valve, for instance valve (7'), in the operative hydraulic circuit, for instance (25', 28', 7', 31', 32, 9, 25) is closed, whereby the weight (4) consequently can always move inwards, towards the vessel centre line or centre.

5. A control unit as claimed in claim 1, characterized in that closely adjacent each stop valve (7, 7') a valve (38, 38') is provided, said valve having a fixed or adjustable throttling function, so that each valve (38, 38') regulates the speed of movement of the weight (4) in a direction outwards, from the vessel centre.

6. A control unit as claimed in claim 1, characterized in that a valve (39, 39') is inserted in each by-pass line (30, 30'), said valve having a fixed or adjustable flow throttling function, so that each valve (39, 39') regulates the speed of movement of the weight (4) inwards, towards the vessel centre, said regulation taking place in the path of flow (30, 30') that is always open to the flow corresponding to the movement of the weight towards the centre.

7. A control unit as claimed in claim 1, characterized in that a valve (38, 38') having a closing function is provided closely adjacent the associated stop valve (7, 7'), so that upon closure of the respective valve (38, 38') movement of the weight (4) is prevented in a direction outwards, away from the centre in the corresponding direction, i.e. to the right or to the left, irrespective of where, athwartships, the weight is positioned.

8. A control unit as claimed in claim 1, characterized in that in each by-pass line (30, 30') there is a valve (39, 39') having a closing function, so that the movement of the weight (4) in a direction towards the centre is prevented by way of the flow path (30, 30') that otherwise is always open to flow corresponding to the movement of the weight inwards, towards the centre.

9. A control unit as claimed in claim 1, characterized in that each sensing unit (8, 8') is conceived in such a manner that the position, in which it keeps the associated stop valve (7, 7') in closed condition, has some priority over the position in which it keeps the corresponding stop valve (7, 7') open, this being made possible for instance by arranging for the associated rocking member (8, 8') to have a steeper tilt in the position corresponding to the closing function compared with the position corresponding to the opening function, or else by arranging for the associated rocking member (8, 8') to be spring biased, whereby it is urged towards the position for effecting closing, so that in this manner, upon small rolling movements, the rocking members remain in the positions corresponding to closing and in this manner small movements of the weight (4) are avoided at these instances.

10. A control device as claimed in claim 2, characterized in that the unit is constructed from a hydraulic system comprising a double-acting cylinder the piston rod and thus also the piston of which are connected to the wight by means of for instance control lines in such a manner that the piston rod will move when the weight moves and thus a flow of fluid is created in the hydraulic system, and a first and a second stop valve which are actuated by a first and a second sensing unit and a shift valve are included in the hydraulic system in such a manner that when the weight is positioned to one side of the vessel centre line athwartships, e.g. to the left side, the shift valve will cause the second stop valve in an operative hydraulic circuit to be connected whereas in this case the first stop valve is not part of said operative hydraulic circuit, wherein flow from one side of the cylinder to the other one must occur, when the weight is to move outwards, athwartships, such that when the second stop valve, which is in said operative hydraulic circuit, is displaced by its associated sensing unit to a stop position, the movement of the wight is stopped, so that the weight is stopped, so that the wight is prevented from moving further away outwards from the vessel centre line athwartships, and, if the wight instead assumes a position on the opposite side of the vessel centre line, i.e. the right-hand side, a hydraulic circuit now becomes operative and the function becomes entirely analoguous, owing to the symmetrical construction of the system.

11. A control unit as claimed in claim 2, characterized in that each stop valve is supplemented with a by-pass line, each provided with its respective non-return valve, whereby flow is allowed past the associated stop valve in one direction but not in the opposite one and consequently the wight can move toward the vessel centre line athwartships also when the stop valve, for instance is closed, whereby the weight consequently can always move inwards, towards the vessel centre line or centre.

12. A control unit as claimed in claim 3, characterized in that each stop valve is supplemented with a by-pass line, each provided with its respective non-return valve, whereby flow is allowed past the associated stop valve in one direction but not in the opposite one and consequently the wight can move toward the vessel centre line athwartships also when the stop valve, for instance is closed, whereby the weight consequently can always move inwards, towards the vessel centre line or centre.

13. A control unit as claimed in claim 2, characterized in that closely adjacent each stop valve is provided, said valve having a fixed or adjustable throttling function, so that each valve regulates the speed of movement of the wight in a direction outwards, from the vessel centre.

14. A control unit as claimed in claim 3, characterized in that closely adjacent each stop valve is provided, said valve having a fixed or adjustable throttling function, so that each valve regulates the speed of movement of the wight in a direction outwards, from the vessel centre.

15. A control unit as claimed in claim 4, characterized in that closely adjacent each stop valve is provided, said valve having a fixed or adjustable throttling function, so that each valve regulates the speed of movement of the wight in a direction outwards, from the vessel centre.

16. A control unit as claimed in claim 2, characterized in that a valve is inserted in each by-pass line said valve having a fixed or adjustable flow throttling function, so that each valve regulates the speed of movement of the weight inwards, towards the vessel centre, said regulation taking place in the path of flow that is always open to the flow corresponding to the movement of the wight towards the centre.

17. A control unit as claimed in claim 3, characterized in that a valve is inserted in each by-pass line said valve having a fixed or adjustable flow throttling function, so that each valve regulates the speed of movement of the weight inwards, towards the vessel centre, said regulation taking place in the path of flow that is always open to the flow corresponding to the movement of the wight towards the centre.

18. A control unit as claimed in claim 4, characterized in that a valve is inserted in each by-pass line said valve having a fixed or adjustable flow throttling function, so that each valve regulates the speed of movement of the weight inwards, towards the vessel centre, said regulation taking place in the path of flow that is always open to the flow corresponding to the movement of the wight towards the centre.

19. A control unit as claimed in claim 5, characterized in that a valve is inserted in each by-pass line said valve having a fixed or adjustable flow throttling function, so that each valve regulates the speed of movement of the weight inwards, towards the vessel centre, said regulation taking place in the path of flow that is always open to the flow corresponding to the movement of the wight towards the centre.

20. A control unit as claimed in claim 2, characterized in that a valve having a closing function is provided closely adjacent the associated stop valve, so that upon closure of the respective valve movement of the wight is prevented in a direction outwards, away from the centre in the corresponding direction, i.e. to the right or to the left, irrespective of where, athwartships, the weight is positioned.

* * * * *